US009975671B2

(12) United States Patent
Jobges

(10) Patent No.: US 9,975,671 B2
(45) **Date of Patent: *May 22, 2018**

(54) CAN, HOLDING DEVICE AND METHOD FOR PROVIDING A CAN

(71) Applicant: BALL EUROPE GMBH, Zurich (CH)

(72) Inventor: Udo Jobges, Duren (DE)

(73) Assignee: BALL EUROPE GMBH, Zurich (CH)

( * ) Notice: Subject to any disclaimer, the term of this patent is extended or adjusted under 35 U.S.C. 154(b) by 610 days.

This patent is subject to a terminal disclaimer.

(21) Appl. No.: 14/414,314

(22) PCT Filed: Jun. 24, 2013

(86) PCT No.: PCT/EP2013/063133

§ 371 (c)(1),
(2) Date: Jan. 12, 2015

(87) PCT Pub. No.: WO2014/009136

PCT Pub. Date: Jan. 16, 2014

(65) Prior Publication Data

US 2015/0144629 A1 May 28, 2015

(30) Foreign Application Priority Data

Jul. 13, 2012 (DE) ..... 10 2012 212 359

(51) Int. Cl.
*B65D 77/28* (2006.01)
*B65D 45/02* (2006.01)
(Continued)

(52) U.S. Cl.
CPC ..... *B65D 45/02* (2013.01); *A47G 21/18* (2013.01); *B65B 3/04* (2013.01); *B65B 7/2842* (2013.01);
(Continued)

(58) Field of Classification Search
CPC ..... B65D 77/24; B65D 77/28; B65D 77/283; B65D 2517/0049
(Continued)

(56) References Cited

U.S. PATENT DOCUMENTS 4,109,817 A * 8/1978 Payne ..... B65D 77/283 220/706
4,356,927 A 11/1982 Cooper et al.
(Continued)

FOREIGN PATENT DOCUMENTS

AT 502 989 B1 4/2008
AT 010 442 U2 3/2009
(Continued)

OTHER PUBLICATIONS

Search Report for Russian Patent Application No. 2015104877/12, dated May 4, 2017, 4 pages.
(Continued)

*Primary Examiner* — Anthony Stashick
*Assistant Examiner* — Mollie Impink
(74) *Attorney, Agent, or Firm* — Sheridan Ross PC

(57) ABSTRACT

The invention relates to a can which, after it is filled, is closed by fitting a cover, and also to an apparatus which is intended to be inserted into an initially open can, and to a method for providing a can. The can according to the invention is characterized in that an apparatus is located in the can, the said apparatus being arranged and designed in such a way that it is moved from a first state to a second state when a cover is fitted onto the initially open can.

20 Claims, 6 Drawing Sheets

Figure 1:
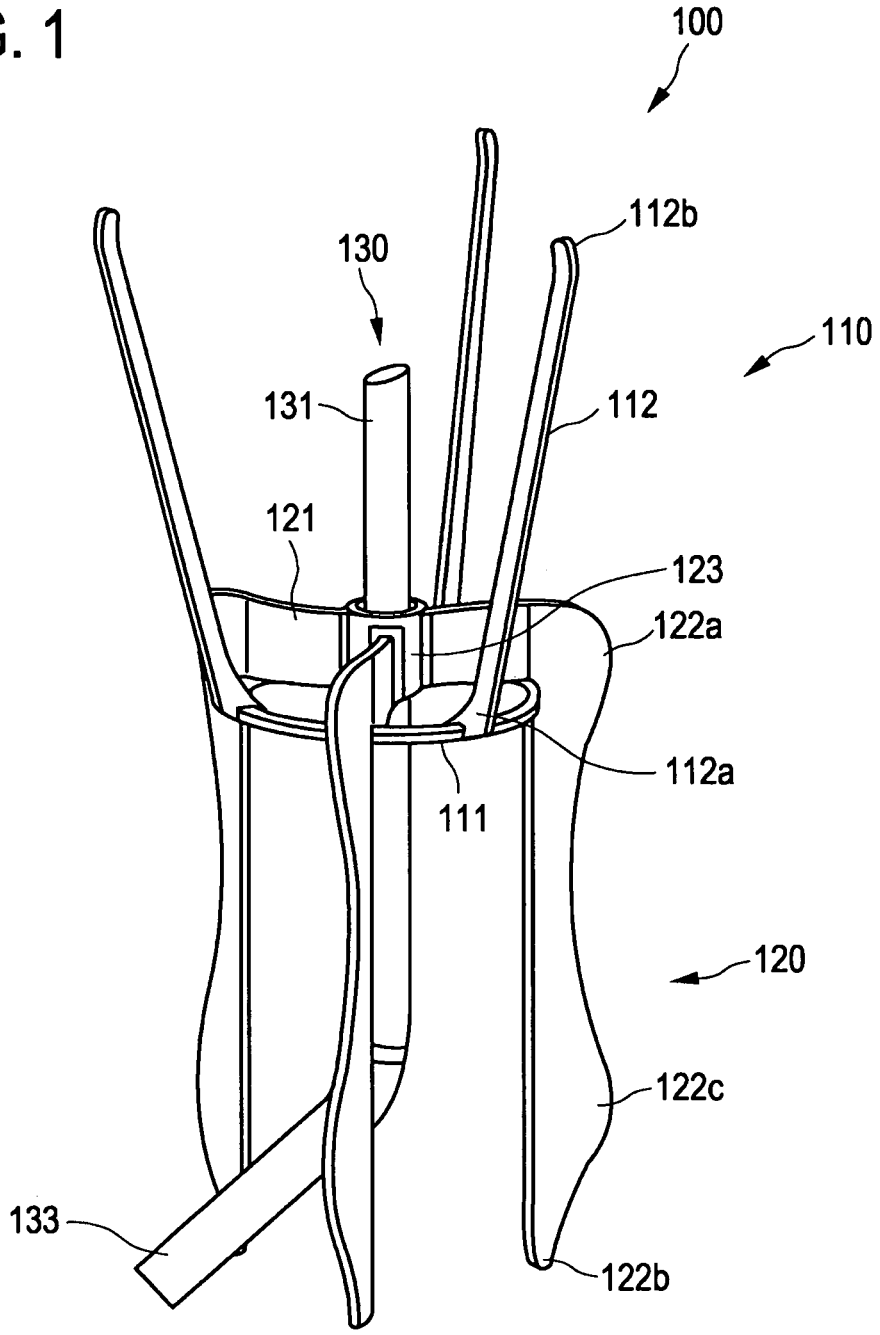

(51) Int. Cl.

| | |
|---|---|
| ***B65D 85/804*** | (2006.01) |
| ***A47G 21/18*** | (2006.01) |
| ***B65B 3/04*** | (2006.01) |
| ***B65B 7/28*** | (2006.01) |
| ***B65D 25/02*** | (2006.01) |
| *B65D 81/00* | (2006.01) |
| *B65D 85/73* | (2006.01) |

(52) U.S. Cl.
CPC ..... *B65D 25/02* (2013.01); *B65D 77/283* (2013.01); *B65D 85/804* (2013.01); *B65D 85/73* (2013.01); *B65D 2081/001* (2013.01); *B65D 2517/0049* (2013.01); *Y10T 83/0596* (2015.04)

(58) Field of Classification Search
USPC ..... 215/389, 388; 220/706, 709
See application file for complete search history.

(56) References Cited

U.S. PATENT DOCUMENTS

| | | | | |
|---|---|---|---|---|
| 4,892,187 | A | 1/1990 | Stein | |
| 4,930,652 | A * | 6/1990 | Murphy | B65D 77/283 215/388 |
| 5,054,639 | A | 10/1991 | Ahn | |
| 5,431,297 | A | 7/1995 | Rosello | |
| 5,482,158 | A * | 1/1996 | Plester | B65D 77/24 206/217 |
| 5,609,038 | A | 3/1997 | Halimi | |
| 5,819,979 | A | 10/1998 | Murphy et al. | |
| 5,975,340 | A * | 11/1999 | Cornell | A47G 21/18 220/706 |
| 6,264,057 | B1 | 7/2001 | Kim | |
| 6,401,262 | B2 | 6/2002 | Bacchiega | |
| 7,516,869 | B1 | 4/2009 | Hajianpour | |
| 2001/0054618 | A1 | 12/2001 | Ferrari | |
| 2002/0125261 | A1 | 9/2002 | Kim | |
| 2010/0051629 | A1 | 3/2010 | Ravelo et al. | |

FOREIGN PATENT DOCUMENTS

| | | | | |
|---|---|---|---|---|
| CN | 1244848 | | 2/2000 | |
| DE | 10 2010 023861 | A1 | 12/2011 | |
| DE | 102010023861 | | 12/2011 | |
| EP | 0673855 | | 9/1995 | |
| EP | 1 155 629 | A2 | 4/2001 | |
| EP | 1 073 593 | B1 | 12/2003 | |
| EP | 1 572 553 | B1 | 12/2003 | |
| EP | 2 128 039 | A1 | 12/2009 | |
| EP | 2 215 936 | A1 | 8/2010 | |
| FR | 807033 | | 12/1936 | |
| FR | 1 246 318 | A | 11/1960 | |
| FR | 2 579 959 | A1 | 10/1986 | |
| GB | 2 447 932 | A | 10/2008 | |
| JP | 2584725 | B2 * | 2/1997 | B65D 83/205 |
| JP | 2009-132433 | | 6/2009 | |
| RU | 2246433 | | 2/2005 | |
| WO | WO 99/26861 | | 6/1999 | |
| WO | WO 2004/101389 | A1 | 5/2004 | |
| WO | WO 2008/072060 | A1 | 6/2008 | |
| WO | WO 2010/029443 | A2 | 3/2010 | |
| WO | WO 2010/101389 | | 9/2010 | |
| WO | WO 2010/130858 | A1 | 11/2010 | |
| WO | WO 2011/054474 | A1 | 5/2011 | |
| WO | WO 2011/107123 | A1 | 9/2011 | |
| WO | WO 2014/009136 | | 1/2014 | |

OTHER PUBLICATIONS

International Search Report prepared by the European Patent Office dated Jan. 31, 2014, for International Application No. PCT/EP2013/063133.
U.S. Appl. No. 15/688,579, filed Aug. 28, 2017, Joebges.
Notice of Acceptance for Australia Patent Application No. 2013289490, dated Apr. 19, 2017 3 pages.
English Translation of Decision to Grant for Russia Patent Application No. 2015104877/12, dated May 24, 2017 4 pages.
International Search Report (with English translation) for International (PCT) Patent Application No. PCT/EP2014/066602, dated Jan. 22, 2015, 10 pages.
Written Opinion (with English translation) for International (PCT) Patent Application No. PCT/EP2014/066602, dated Jan. 22, 2015, 18 pages.
International Preliminary Report on Patentability (with English translation) for International (PCT) Patent Application No. PCT/EP2014/066602, dated Mar. 15, 2016, 20 pages.
English Translation of Official Action for China Patent Application No. 201480050618.7, dated Mar. 2, 2017, 9 pages.
English Translation of Official Action for China Patent Application No. 201480050618.7, dated Aug. 3, 2017 5 pages.
Official Action for U.S. Appl. No. 15/021,597, dated Jan. 10, 2017, 9 pages.
Notice of Allowance for U.S. Appl. No. 15/021,597, dated Apr. 27, 2017 8 pages.
Notice of Acceptance for Australia Patent Application No. 2014320701, dated Feb. 16, 2018 3 pages.
Notice of Grant (with English translation) for China Patent Application No. 201480050618.7, dated Feb. 7, 2018 5 pages.

* cited by examiner

CAN, HOLDING DEVICE AND METHOD FOR PROVIDING A CAN

CROSS REFERENCE TO RELATED APPLICATIONS

This application is a national stage application under 35 U.S.C. 371 and claims the benefit of PCT Application No. PCT/EP2013/063133 having an international filing date of Jun. 24, 2013, which designated the United States, which PCT application claimed the benefit of German Patent Application No. 10 2012 212 359.8 filed Jul. 13, 2012, the disclosure of each of which are incorporated herein by reference in their entirety.

The invention relates to a can which, after it is filled, is closed by fitting a cover.

The invention further relates to an apparatus, in particular a holding device, which is intended to be inserted into an initially open can which, after it is filled, is closed by fitting a cover.

The invention further relates to a method for providing a can which, after it is filled, is closed by fitting a cover.

Cans of the kind cited in the introductory part are, for example, beverage can bodies, preferably composed of metal, which, after they are filled with a beverage, is closed by fitting a beverage can cover, preferably by producing a folded flange between the beverage can body and the can cover.

A cover for closing the can is preferably designed to be opened by a user, for example by operating an opening element. The cover can be substantially entirely opened or opened only in a subregion, as is the case, for example, with drinking openings of beverage cans which are opened by a user operating a tab.

In addition to the basic function of presenting a container which can be closed by fitting a cover, it is preferred in different fields of use to provide further features or properties of the can which can simplify the use or handling of the said can or to influence a product or medium which is arranged in the can.

By way of example, AT 502 989 B1, AT 10 442 U2, EP 2 215 936 A1, EP 2 128 039 A1, US 2001/0054618 A1, US 2010/0051629 A1, U.S. Pat. No. 7,516,869 B1, U.S. Pat. No. 6,264,057 B1, U.S. Pat. No. 4,892,187, U.S. Pat. No. 5,431,297, U.S. Pat. No. 4,356,927, U.S. Pat. No. 5,819,979, U.S. Pat. No. 5,054,639, JP 2009-132433, WO 2010/029443 A2, WO 2001/101389 A1 and WO 2008/072060 A1 disclose arranging a straw in a beverage container. EP 1 073 593 B1, EP 1 155 629 B1 and EP 1 572 553 B1 also disclose providing a, possibly pressure-activated, container for receiving an additive, for example a liquid possibly with a gas dissolved therein, in a beverage can, so that the additive is mixed into a main beverage liquid after the beverage can is opened.

However, these solutions have various disadvantages, in particular handling and the filling process for the can are adversely affected for example, the production process of a can is more complex, time-consuming and costly overall and the solutions often do not deliver the desired result.

Therefore, an object of the present invention is to provide a can of the kind cited in the introductory part which reduces or eliminates one or more of the said disadvantages. Another object of the present invention is to provide an apparatus, in particular a holding device, of the kind mentioned in the introductory part which reduces or eliminates one or more of the said disadvantages. A further object of the invention is to provide a method of the kind cited in the introductory part which reduces or eliminates one or more of the said.

This object is achieved by a can which, after it is filled, is closed by fitting a cover, the said can being characterized in that an apparatus is located in the can, the said apparatus being arranged and designed in such a way that it is moved from a first state to a second state when a cover is fitted onto the initially open can.

The invention is based on the finding that an apparatus which first moves from a first state to a second state when the can is closed by fitting a cover can be inserted into the initially open can. This has the advantage that the apparatus is in the first state during the production, manipulation and filling of the open, still unclosed can. Within the scope of this description, this first state is called the passive state, and the second state is called the active or activated state. The transition from the first, passive state to the second, active state is called activation in this case. Therefore, according to the invention, activation of the apparatus is triggered by a cover being fitted onto the can.

It is particularly preferred for a holding device to be located in the can, the said holding device being formed by two parts which are releasably connected to one another and are arranged and designed in such a way that, when a cover is fitted onto the initially open can, at least one of the two parts comes into contact with the cover in such a way that at least one section of the connection between the two parts is released.

This is based on the finding that a holding device of which the two parts are first released from one another when the can is closed by fitting a cover can be inserted into the initially open can. This has the advantage that the holding device is in a first state, in which the two parts are connected to one another, during the production, handling and filling of the open, still unclosed can. Within the scope of this description, this first state is called the passive state, and the second state, in which at least one section of the connection between the two parts of the holding device is released, is called the active or activated state. The transition from the passive state to the active state is called activation in this case.

Therefore, activation of the apparatus, in particular of the holding device, is preferably triggered by a cover being fitted onto the can. During a filling process of the can with a filling medium, for example a beverage, the two parts of the holding device are releasably connected to one another. In this state in which the two parts are connected to one another, at least one of the two parts comes into contact with a cover when the cover is fitted onto the initially open can.

By way of example, the cover can be in the form of a can cover for a beverage can and have a peripheral core beading which projects furthest into the interior of the can compared to the other regions of the can cover when and after it is fitted onto a can. Therefore, there may preferably be contact between the apparatus, in particular the holding device, and that side of the core beading which faces the interior of the can. However, it is likewise possible for other regions of a beverage can cover, but preferably those which face the interior of the can, to trigger activation of the apparatus, in particular of the holding device, by making contact with the said apparatus, in particular the said holding device.

Therefore, the apparatus, in particular the holding device, is preferably activated only when the can is closed after a filling process. That is to say, the apparatus, in particular the holding device, which is located in the can is in the passive state before the can is closed by fitting a cover. The apparatus, in particular the holding device, is preferably formed in the passive state such that a production, handling or filling process of the can is not adversely affected or at least only insignificantly adversely affected by the apparatus, in particular the holding device.

The apparatus, in particular the holding device, is preferably rotationally symmetrical in the passive and/or active state. One of the parts or the two parts of the holding device can preferably have a recess for receiving a further element, for example a straw, and/or a reservoir for receiving a substance. In the state in which they are connected to one another, the two parts of the holding device are preferably arranged in such a way that one of the two parts can be considered to be facing the closed base of the can, and the other part can be considered to be facing the open end of the can.

One preferred embodiment of the can is characterized in that the apparatus, in the first state, has a shape which limits a movement between the apparatus and the can, preferably limits a translational movement in the axial direction.

One preferred embodiment of the can is characterized in that the holding device, in the state in which the said two parts are connected to one another, has a shape which limits a movement between the holding device and the can, preferably limits a translational movement in the axial direction.

In the passive state, the apparatus, in particular the holding device, is preferably designed in such a way that it cannot move freely in the still open can, but rather the movement of the apparatus, in particular of the holding device, relative to the can is limited. In particular, it is preferred for displacement of the apparatus, in particular of the holding device, along a longitudinal axis or along a rotation axis of a preferably rotationally symmetrical can to be possible only within specific limits or not at all, so that the apparatus, in particular the holding device, is prevented from falling out of the still open can. In the case of beverage cans, this can be achieved, for example, by the apparatus, in particular the holding device, having, at least in sections, a larger diameter than the open end of the can which is preferably tapered in relation to the rest of the beverage can body. The apparatus, in particular the holding device, can have one or more sections which, in the interior of the can, are supported against this tapered region at the open end of the can.

An embodiment of this kind is particularly preferred since it allows the can to be handled in any desired manner in the open state with the holding device inserted, that is to say, for example, even upside-down, that is to say with the open end of the can pointing substantially downward in the direction of gravity, without the apparatus, in particular holding device, which is arranged in the still open can falling out. To this end, the apparatus, in particular the holding device, can preferably have approximately the same extent as the can in the direction of a longitudinal axis of the can. The holding device can bear against the closed face of the can, for example, by way of one of the two parts, and against the open end of the can, which is preferably slightly conically tapered, by way of the other of the two parts. In particular, the part of the holding device which preferably bears against the open end of the can can be prestressed in such a way that this part is supported against the open end of the can, in particular against the tapered region.

An upside-down orientation of this kind of the can is intended, for example, for beverage can bodies during the washing process, in which an elongation agent which is used for shaping the can is removed by the beverage can body being transported upside-down through a plurality of washing chambers in which the outsides of cans are rinsed with water by nozzles which are arranged at the top and the insides of cans are rinsed with water by nozzles which are arranged at the bottom. It is advantageous when the apparatus, in particular the holding device, is already located in the can during the washing process since, in particular when the can is used in the food sector, it is possible to ensure in this way that the apparatus, in particular the holding device, which comes into contact with the contents, which are to be consumed, during filling of the can has been pre-rinsed and therefore has the same hygiene properties as the interior of the can.

Furthermore, the apparatus, in particular the holding device, is preferably translationally immobile or at least limited in a radial direction in the passive state, so that it maintains a preferably substantially concentric arrangement in the interior of the can.

One preferred embodiment is characterized in that the connection between the two parts of the holding device is a cohesive connection, and therefore the two parts are of integral design in the connected state and a predetermined breaking point between the two parts preferably breaks when a cover is fitted onto the initially open can.

An integral design of the holding device in the passive state has the advantage that no separate parts have to be produced and mounted. In order to release a section of the connection between the two parts, a predetermined breaking point is preferably provided, for example a material weakening or a geometric variation such that the cohesive connection of the initially integral holding device is severed in a specific region. The cohesive connection between the two parts of the holding device can also be completely severed, so that there is no longer a connection between the two parts in the activated state.

An alternative embodiment is characterized in that the connection between the two parts of the holding device is a mechanical connection.

As an alternative to the initial integral design, the holding device can also comprise two mechanically connected parts. This is advantageous when the two parts are composed, for example, of different materials and/or are intended to be produced using different production methods.

The mechanical connection is preferably a plug, clamping or latching connection.

A further preferred embodiment is characterized in that the connection can be released by a movement of the two parts of the holding device relative to one another in the direction of a longitudinal axis of the can.

In this embodiment, the activation of the holding device follows due to a movement between the two parts substantially along a longitudinal axis of the can, that is to say in the axial direction. This embodiment is independent of the type of connection of the parts, that is to say it can be applied both for the cohesive connection and also for the mechanical connection of the two parts in the passive state.

In the case of rotationally symmetrical cans, the longitudinal axis preferably corresponds to the rotation axis. An axial relative movement of the two parts is preferred for activation since this can be implemented particularly easily when a cover is fitted onto the initially open can and contact is made between the holding device and the cover.

It is further particularly preferred for the two parts of the holding device, in the state in which they are connected to one another, to be arranged in such a way that a pressure is applied to the holding device in the axial direction when a cover is fitted onto the initially open can.

It is preferred for a pressure of this kind to be applied at least to one of the two parts in the direction of the longitudinal axis of the can, so that at least one section of the connection between the two parts is released, that is to say the holding device is activated. This can be achieved, for example, by way of the extent of the holding device, in the passive state, being longer in the direction of the longitudinal axis of the can than a distance between the closed base of the can and the surface of the cover which faces the interior of the can after the cover has been closed by the can. In this way, less space is available for the holding device in the axial direction after the can is closed than before closing. Therefore, fitting the cover exerts an axial pressure on the holding device, the said pressure preferably leading to activation of the holding element which can be implemented, for example, by a relative movement of the two parts in relation to one another.

It is particularly preferred for a lower face of the core beading which faces the interior of the can to come into contact with a part of the holding device when the cover is fitted, since the lower face of the core beading of a can cover usually projects furthest into the interior of the can in comparison to other regions of the can cover and therefore reduces the space available for the holding device in the axial direction to the greatest extent.

A further preferred embodiment is characterized in that one of the two parts or the two parts of the holding device has or have supporting arms which are formed such that the supporting arms or at least a respective section of the supporting arms bear/bears against an inner wall of the can or at least come/comes very close to the inner wall.

These supporting arms are preferably designed and arranged in such a way that they come into contact with an inner wall, that is to say the cylindrical part of the interior of the can, the closed face of the can or a tapered region at the open end of the can, or are at only a very small distance from the inner wall. The supporting arms are preferably prestressed toward the outside in the radial direction, so that they can be pressed together, against the prestress direction, to such an extent that they can be inserted into the interior of the can through the open end of the can and, in the interior of the can, again move radially outward, owing to prestress, to such an extent that they come into contact with the inner wall or are not at a great distance from the said inner wall. In this way, it is possible for the holding device to be easily inserted into the open can, but remain in the said can, for example, even when the open can is tipped upside down. This design of the supporting arms can be provided in the case of only one part or in the case of the two parts of the holding device. This design of the supporting arms is particularly preferred in the case of that part of the holding device which faces the open end of the can.

The supporting arms of one or of the two parts of the holding device preferably extend substantially along the longitudinal axis of a can. When the two parts have supporting arms, the said supporting arms preferably extend in the opposite direction substantially parallel to the longitudinal axis of a can and their joint total extent preferably corresponds approximately to the extent of the can along its longitudinal axis.

A further preferred embodiment is that each of the two parts has a connecting section on which the supporting arms are arranged, wherein the two parts, in the connected state, are arranged in such a way that the supporting arms of the first part extend beyond the connecting section of the second part, and the supporting arms of the second part extend beyond the connecting section of the first part in the axial direction, wherein the connecting sections are preferably releasably connected to one another.

In this embodiment, the two parts of the holding device can be designed, for example, as follows: each of the two parts has a connecting section to which the respective supporting arms are, preferably cohesively, connected by way of a first end and from which the supporting arms in each case extend substantially parallel to the longitudinal axis of the can. In this case, the second ends of the supporting arms preferably point slightly radially outward in relation to the first first ends of the supporting arms, which ends are connected to the connecting section. As an alternative, the connecting section of at least one part can also extend substantially over the entire cross section of the interior of the can, so that the supporting arms extend from there, in the vicinity of the inner wall of the can, substantially parallel to the longitudinal direction.

One or the two connecting sections can preferably be circular, annular or star-shaped.

The connecting sections of the two parts are preferably arranged directly adjacent to one another in the passive state of the holding device, wherein the supporting arms of each part each extend beyond the connecting section of the other part and the two connecting sections are releasably connected to one another. In the activated state, it is preferred for the two connecting sections to be released from one another and to be separated from one another, preferably by a translational movement of at least one of the two parts substantially along the longitudinal axis of the can.

It is particularly preferred for a recess for receiving a further element, such as a straw for example, to be arranged in the connecting section of one of the two parts.

A further preferred embodiment is a reservoir which is arranged on one of the two parts, wherein release of at least one section of the connection between the two parts causes a substance to be released from the reservoir. In this embodiment, a substance, which is arranged in a container or reservoir which is closed in the passive state of the holding device but is opened when the holding device is activated, is released owing to the activation of the holding device. This substance can preferably cause a change or improvement in the medium, for example a beverage, which is arranged in the filled and closed can. An effect of this kind may relate, for example, to the visual properties, the taste and/or the consistency of a medium.

A further preferred embodiment is characterized in that at least one of the two parts is formed such that it can move relative to the can after the connection is released.

In the activated state, one of the two parts can preferably move in relation to the can, that is to say can move in the interior of the can, so that a movement can take place only within the limits of the can. The ability to move along a longitudinal axis of the can and/or to rotate about the longitudinal axis of the can is particularly preferred. However, the moving part is preferably translationally immobile or at least limited in the radial direction, so that it maintains a substantially concentric arrangement in the interior of the can in the activated state.

The two parts can also move relative to the can after activation of the holding device.

It is particularly preferred for the moving part to have a lower density than a filling medium with which the can is filled during a filling process.

The density of the moving part is preferably matched to the filling medium such that the moving part floats in the filling medium. This has the result that, in the passive state of the holding device, that is to say when the two parts are connected to one another, the holding device does not float in the still open can, but rather is prevented from performing a translational movement along the longitudinal axis of the can owing to supporting arms bearing against the tapered open end of the can. After the holding device is activated and the connection between the two parts is released, the moving part can preferably float substantially along the longitudinal axis of the can.

In a particularly preferred embodiment, a straw is arranged on the moving part. This straw is preferably fixedly connected to the moving part, so that the straw moves in line with the moving part. The straw is preferably arranged on the moving part in such a way and the extent for receiving the straw on the part is preferably arranged in such a way that, after the can is opened, the moving part with the straw floats such that the straw is driven out through a drinking opening in the can.

The movement of the moving part can preferably also be further inhibited, after activation of the holding device by fitting the cover, by a further element, for example a straw. When the straw is arranged on a part of the holding device in such a way that it projects axially in the direction of the can cover, the moving part, in spite of a relatively low density, cannot float when the beverage can is closed since the straw butts against the can cover and prevents an upward movement of the moving part. However, when the beverage can is opened by a user, the straw—given a corresponding arrangement—can exit from the top of the beverage can through the drinking opening and therefore the moving part, together with the straw, can float in such a way that a user can consume the filling medium, preferably a beverage, which is arranged in the beverage can, using the straw.

In a further preferred refinement, provision is made for the straw to have a drinking end which faces the cover and is closed in the axial direction of the straw and has one, two or more radial openings. The drinking end of the straw is that end which is arranged close to the cover in the interior when the beverage can is closed and which exits from the top of the beverage can when the beverage can is opened, and through which a consumer can consume the beverage. This drinking end is preferably closed in the axial direction, that is to say no medium can exit at the drinking end in the longitudinal direction of the straw or along its longitudinal axis. The drinking end can be closed, for example, by a rounded tip in the axial direction. However, in order that a consumer can extract medium or a beverage at the drinking end, one, two or more radial openings are provided at the drinking end. A radial drinking opening is an opening in the side wall of the straw, which opening is arranged in the radial direction as seen from the longitudinal axis of the straw and can be called a lateral opening. A radial opening can be, for example, round or oval. An embodiment with two radial openings which are situated opposite one another is particularly preferred. The advantage of a straw of this kind is that, particularly in the case of carbonated drinks, the beverage can be prevented from unintentionally spraying out of the straw in the axial direction when the beverage can is opened. Owing to the radial opening, it is at the same time possible to ensure that an adequate flow of media out of the straw is ensured, in particular in order to provide the consumer, when extracting the beverage, with an impression which is as close as possible to that received when using a conventional straw with an axial opening.

According to a further aspect of the invention, the object is achieved by an apparatus, in particular holding device, which is intended to be inserted into an initially open can which, after it is filled, is closed by fitting a cover, characterized in that the apparatus is designed to be moved from a first state to a second state when a cover is fitted onto an initially open can, wherein the holding device is preferably formed by two parts which are releasably connected to one another and are arranged and designed in such a way that, when a cover is fitted onto an initially open can, at least one of the two parts comes into contact with the cover in such a way that at least one section of the connection between the two parts is released.

A further aspect of the invention relates to a straw which is intended to be arranged on one of the two parts of an above-described apparatus, in particular a holding device, the straw having a drinking end which faces the cover and is closed in the axial direction of the straw and has one, two or more radial openings.

A further aspect of the invention is a method for providing a can which, after it is filled, is closed by fitting a cover, comprising the steps of: providing an initially open can, arranging an apparatus, in particular a holding device, in the can, wherein the holding device is preferably formed by two parts which are releasably connected to one another, filling the can, closing the can by fitting a cover, wherein the apparatus is moved from a first state to a second state, and wherein at least one of the two parts of the holding device preferably comes into contact with the cover in such a way in this case that at least one section of the connection between the two parts is released.

The apparatus, in particular holding device, according to the invention and the method according to the invention together with their respective developments exhibit features and, respectively, method steps which make the said apparatus and method particularly suitable for being used for a can according to the invention and its developments. Reference is made to the preceding description with respect to the corresponding features of the can in respect of the advantages, design variants and design details of these further aspects of the invention and the respective developments.

A further aspect of the invention is a method for making at least one radial opening in an above-described drinking straw, wherein material of the drinking straw is removed in the region of the radial opening which is to be produced by means of a paring tool on a side of the paring tool which is averted from the drinking straw.

When producing an above-described straw with radial openings, care should be taken in respect of consumer safety that no material residues enter the interior of the straw. It has been identified that conventional stamping from the outside to the inside cannot be used for producing a straw with radial openings since the stamping waste (also called scrap) cannot be reliably removed from the straw in the process. It has further been identified that although an opposite stamping direction would carry the stamping waste to the outside, this stamping direction cannot be used on account of the limited space within the straw. Therefore, provision is made for a straw with at least one radial opening to be produced using a paring process. In this case, a paring tool is used, material being removed from the outer surface of the straw using the said paring tool in one or more paring steps, so that an opening is produced in the straw owing to this removal. The paring tool is arranged such that it has a side which is averted from the straw (that is to say the interior of the straw) and a side which faces the straw (that is to say the interior of the straw). The paring process is performed in such a way that the material on that side which is averted from the straw is removed using the paring tool, so that the paring tool is located between the interior of the straw and the material which is to be removed. In this way, the arrangement of the paring tool prevents material which is to be removed (paring waste) entering the interior of the straw since, during paring, the radial opening which is produced is covered by the paring tool and the material which is removed during paring drops on the outside. Therefore, the paring tool constitutes a kind of separating plane between the radial opening of the straw and the paring waste.

Figure 2:
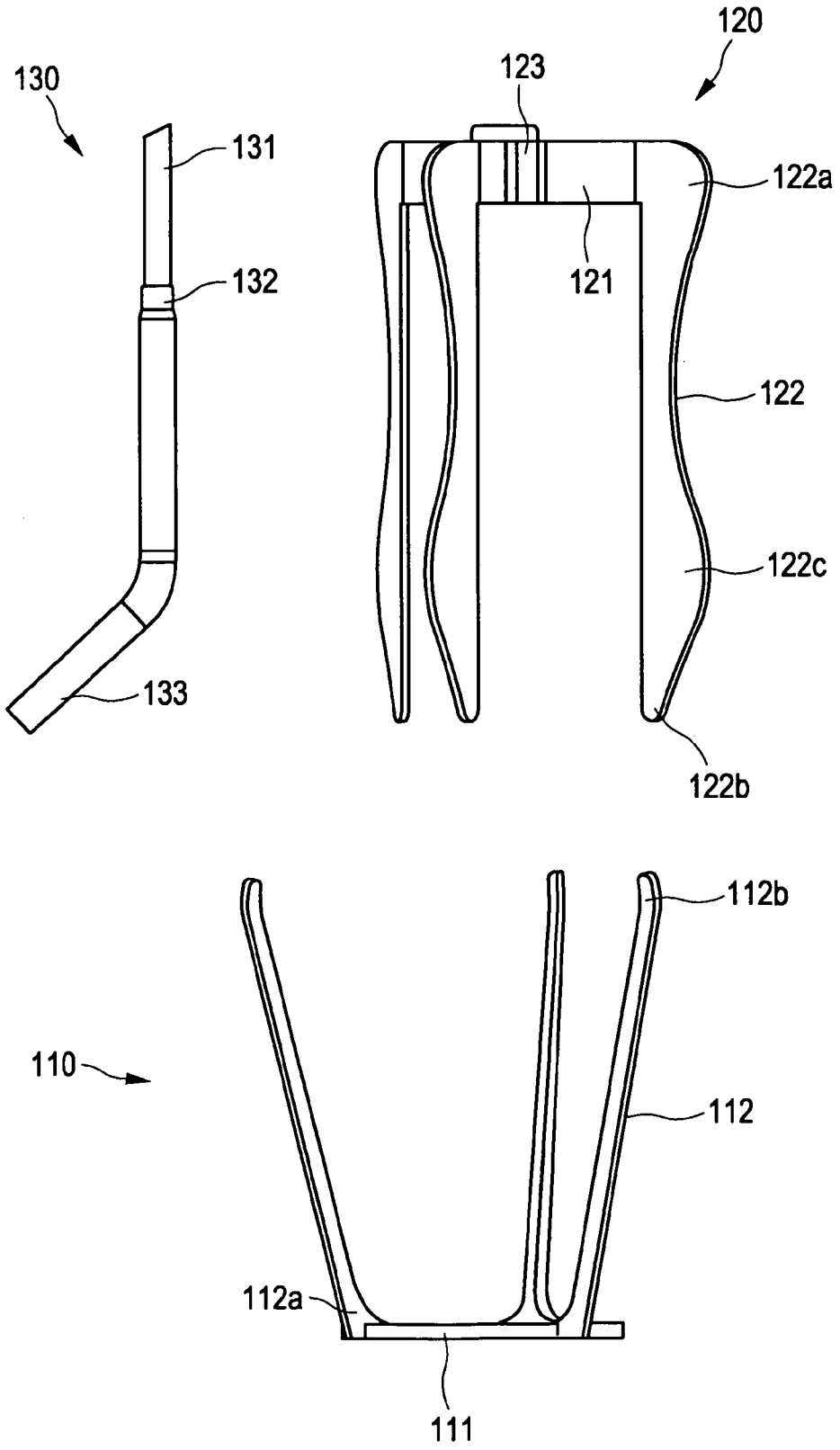
Figure 3:
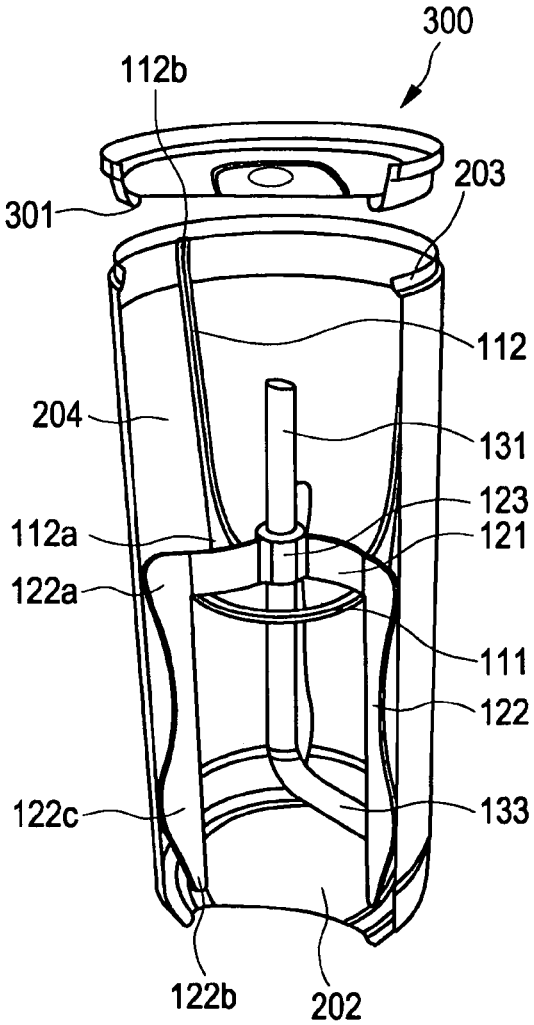
Figure 4:
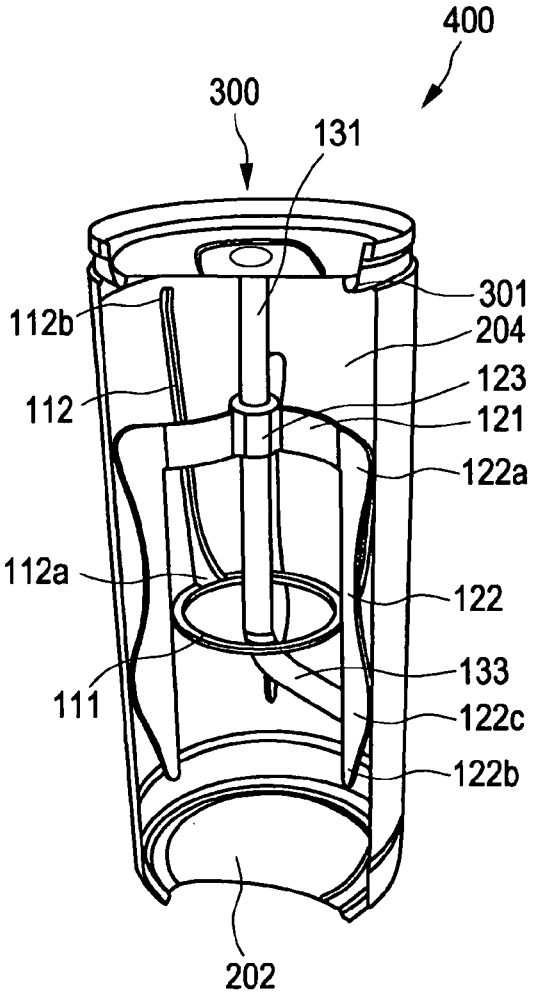
Figure 5:
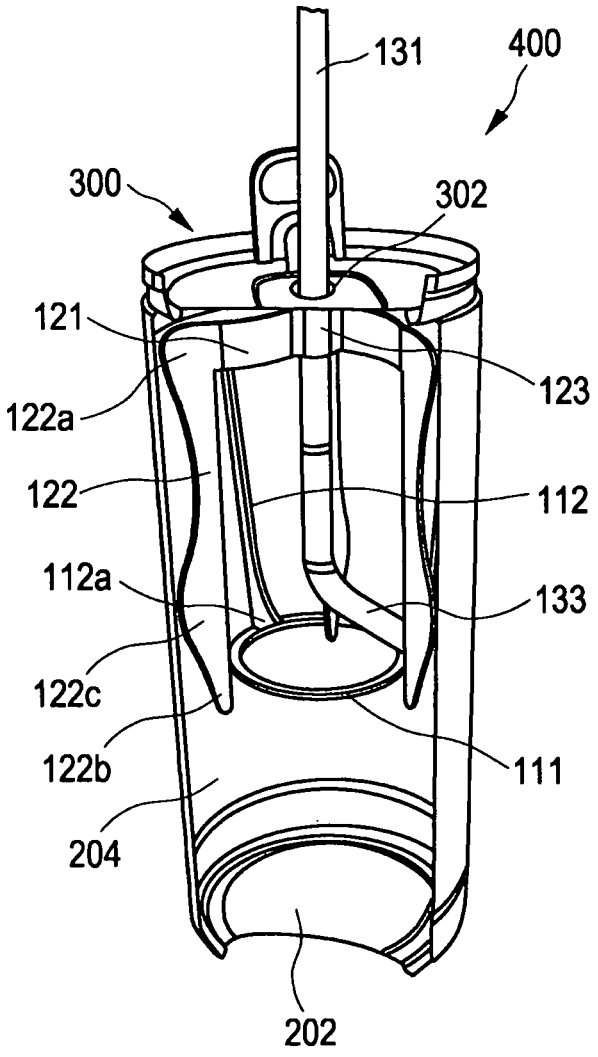
Figure 6:
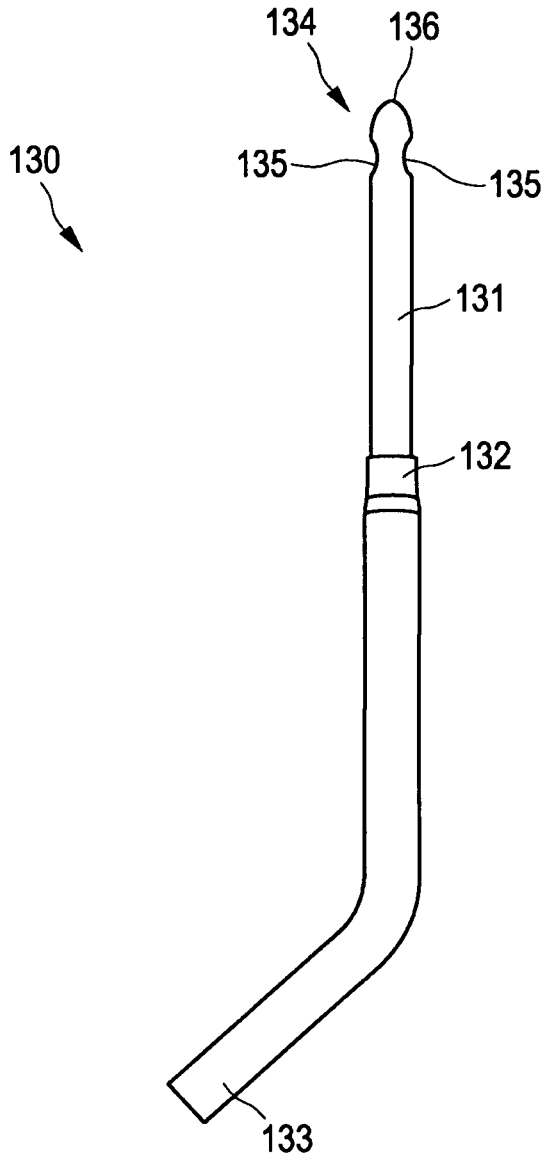
Figure 7:
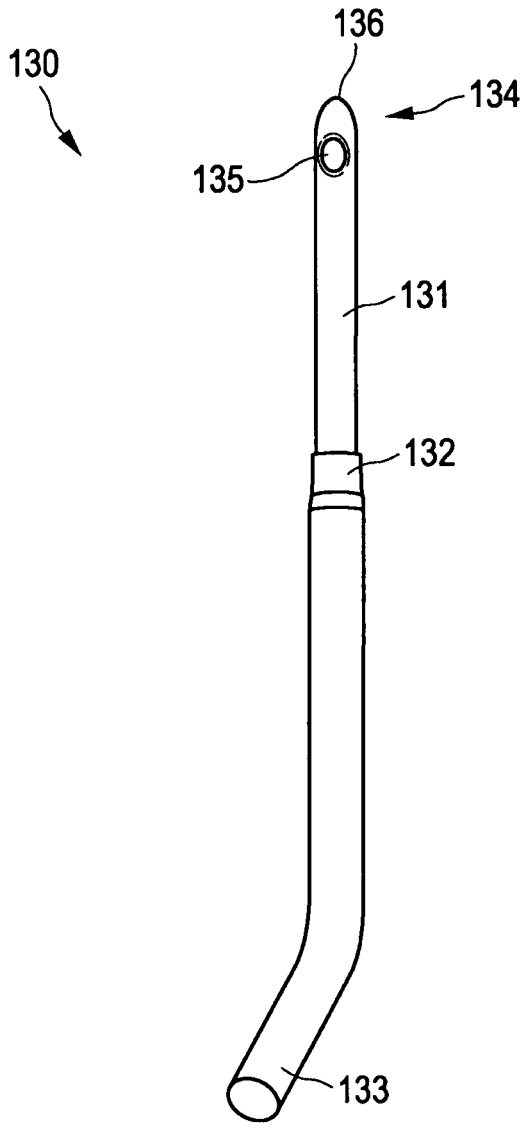

A preferred embodiment of the invention will be explained by way of example with reference to the appended figures, in which:

FIG. 1: shows an example of a holding device with a straw;

FIG. 2: shows the two parts and also the straw of the holding device, illustrated in FIG. 1, separately from one another;

FIG. 3: shows the holding device according to FIG. 1 arranged in a can, with the cover still not fitted;

FIG. 4: shows the can from FIG. 3 with the cover fitted;

FIG. 5: shows the can from FIG. 3 with the cover fitted according to FIG. 4 with the drinking opening open;

FIG. 6: shows a side view of a preferred exemplary embodiment of a straw for a holding device; and FIG. 7: shows a three-dimensional view of the straw according to FIG. 6.

FIGS. 1 to 5 show a holding device 100. The holding device 100 can, as shown in FIGS. 3 to 5, be arranged in a can 200. The can 200, after it is filled, is closed by fitting a cover 300 to form a beverage can 400.

The holding device 100 illustrated here is formed by two parts 110, 120 which are releasably connected to one another. The connection between the two parts 110, 120 of the holding device 100 is a mechanical connection, preferably a latching connection.

Each of the two parts 110, 120 has a connecting section 111, 112, three supporting arms 112, 122 being arranged on each of the said connecting sections. The supporting arms 112, 122 are formed such that they bear against an inner wall 204 of the can 200 or very close to the inner wall 204. The first ends 112*a* of the supporting arms 112 of the part 120 are arranged on the connecting section 111. The connecting section 111 of the part 110 is annular. The second ends 112*b* of the three supporting arms 112 point slightly radially outward in relation to the first ends 112*a* which are connected to the connecting section 111. The three supporting arms 112 of the first part 110 extend substantially parallel to the longitudinal axis of the can 200. The supporting arms 112 bear against the inner wall of the can in the region of the tapered end 203 by way of their second ends 112*b*.

The second part 120 likewise has a connecting section 121 and also three supporting arms 122. The supporting arms 122 are fastened to the connecting section 121 by way of their first ends 122*a* and extend along the longitudinal axis of the can 200. The supporting arms 122 come very close to the inner wall 204 of the can 200, in particular by virtue of the outwardly pre-curved regions at the first end 122*a* and in the region 122*c*. The second ends 122*b* of the supporting arms 122 come into contact with the base 202 of the can 200.

In the connected state of the holding device 100, the two parts 110, 120 are releasably connected to one another at their connecting sections 111, 121. This passive state of the holding device is illustrated in FIGS. 1 and 3. In this state, the holding device 100 has an extent in the direction of the longitudinal or rotation axis of the can 200 which corresponds substantially to the extent of the can 200 along this direction. In this case, the two parts 110, 120 are arranged in the connected state in such a way that the supporting arms 112 of the first part 110 extend beyond the connecting section 121 of the second part 120 and the supporting arms 122 of the second part 120 extend beyond the connecting section 111 of the first part 100 in the axial direction. The part 120 faces the closed base 202 of the can, and the part 110 faces the open end 203 of the can 200.

The connecting section 121 of the second part 120 has a recess 123 for receiving a straw 130. The straw is fastened, for example by a force-fitting connection, to the receptacle 123 of the part 120 by way of its section 132. A section 131 of the straw 130 protrudes axially beyond the connecting section 121 of the part 120 in the direction of the can cover 300 or of the open end 203 of the can 200. A further section 133 of the straw extends in the direction of the base 202 of the can 200 and can preferably be angled in relation to the other sections of the straw 130.

The supporting arms 112, in particular the ends 112*b* of the said supporting arms, are preferably prestressed such that, in the state shown in FIG. 1, an outer circumference around the three second ends 112*b* of the supporting arms 112, in particular a maximum outer circumference, is greater than the minimum circumference of the can 200 at its tapered, open end 203. When the holding device 100 is inserted into the can 200, the supporting arms 112 can preferably be pressed together radially inwardly such that they can be inserted into the interior of the can 200 through the slightly conically tapered end 203 of the can 200 and then can move slightly radially outward again owing to the prestress and can bear against the conically tapered end 203 of the can 200. For this purpose, the shape of the two ends 112*b* of the supporting arms 112 is preferably matched to the conical shape of the tapered end 203 of the can 200.

In the connected state, the holding device 100 has a shape which limits a translational movement between the holding device 100 and the can 200 in the axial direction. In the exemplary embodiments shown here, this is achieved by firstly the second ends 112*b* of the supporting arms 112 bearing against the tapered open end 203 of the can 200 from the inside and secondly the second ends 122*b* of the supporting arms 122 being arranged on or close to the base 202 of the can 200. In this way, the can 200 can also be handled upside-down, for example during a washing process, without the holding device 100 being able to fall out of the open can 200.

The shape of the holding device 100 further prevents a translational movement in the radial direction relative to the can 200 or limits this, so that the holding device 100 maintains a substantially concentric arrangement in the interior of the can 200. In the present exemplary embodiment, the star-shaped design of the connecting section 121 of the second part 120 and the prestress of the supporting arms 112 of the first part 110 particularly contribute to this.

The can 200 with the holding device 100 inserted is preferably filled with a beverage or another medium before a cover 300 is fitted onto the open can 200 and is connected to the open, tapered end 203 of the can 200 by producing a folded flange to form a closed can 400. When the cover 300 is fitted onto the initially open can 200, the part 110, in particular the second ends 112*b* of the supporting arms 112, comes/come into contact with the core beading 301 of the cover in such a way that the latching connection between the connecting sections 111, 112 is released.

The latching connection between the two connecting sections 111, 112 is released by a movement of the two parts 110, 120 relative to one another in the direction of a longitudinal axis of a can 200. This relative movement is generated by a pressure in the axial direction onto the holding device 100, the said pressure being applied to the holding device 100 when the cover 300 is fitted. This pressure is produced by the core beading 301 of the cover 300 projecting into the interior of the can 200 while and after the cover 300 is fitted onto the can 200. In this case, the space which is available for the holding device 100 in the axial direction is limited, so that the core beading 301, when it makes contact with the second end 112*b* of the supporting arms 112 of the part 110, exerts pressure onto the holding device 100 substantially in the axial direction and as a result, the latching connection between the connecting parts 111, 121 is released and therefore the holding device 100 is activated. The activated state of the holding device 100 is illustrated in FIGS. 4 and 5 which differ in that the cover 300 is closed in FIG. 4 and a drinking opening 302 in the cover 300 is open in FIG. 5, so that the straw 130 can exit from the drinking opening 302 by way of its section 131. The two parts 110, 120 are basically freely mobile owing to the connection between them being released, that is to say can move relative to one another and relative to the beverage can 400 in the interior of the beverage can 400 within the limits which are set by the can 200 which is closed by a cover 300.

However, in the situation shown in FIG. 4, the second part 120 is still limited particularly in respect of a translational movement substantially parallel to the longitudinal axis of the beverage can 400 since the section 131 of the straw 130 projects beyond the connecting section 121 of the part 120 in the direction of the cover 300, butts against the closed cover 300 and therefore prevents or limits a movement of the part 120 in the direction of the cover 300.

The part 120 has a lower density than a filling medium, for example a beverage, with which the can 200 is filled during a filling process. In particular, the density of the part 120 is matched to the filling medium in such a way that the part 120 also floats in the filling medium with the straw 130 which is fastened to the connecting section 121.

If the closed beverage can 400 is now opened by a user, for example by operating an opening element, and the straw 130 is arranged in a compatible manner with a drinking opening 302 in the cover 300, the first section 131 of the straw 130 can exit through the drinking opening 302 in the cover 300 and therefore no longer prevents a translational movement of the part 120 relative to the beverage can 400, so that the part 120 can float in the beverage can 400 together with the straw 130 which is fastened to it, and therefore the section 131 of the straw 130 can exit from the beverage can 400, as illustrated in FIG. 5.

FIGS. 6 and 7 show a preferred exemplary embodiment of a straw 130 for an above-described holding device in an above-described beverage can. This straw 130 of FIGS. 6 and 7 is distinguished in that the drinking end 134 is closed by a rounded tip 136 in the axial direction of the straw and has two radial openings 135. The drinking end 134 is the end of the straw 130 which is arranged on the section 131 of the straw 130 and, in the state in which the straw is inserted into a closed beverage can, is arranged close to the cover. When the drinking can is opened, the drinking end 134 exits from the top of the beverage can through a drinking opening, so that a consumer can consume the beverage through the radial openings 135.

Owing to the drinking end being closed in the axial direction by the rounded tip 136, no medium can exit 134, and therefore the beverage can be prevented from undesirably spraying out of the straw 130 in the axial direction, in particular when a can containing a carbonated beverage is opened.

The two radial or lateral drinking openings 135 are situated opposite one another and are oval. The said drinking openings are an opening arranged in the side wall of the straw 130, which opening is arranged in the radial direction as seen from the longitudinal axis of the straw 130. A consumer can extract a beverage in a reliable and simple manner through the radial opening 135.

The invention claimed is:

1. A straw holding device operable for use within a beverage container, the straw holding device comprising:

a first part and a second part, each of the first part and the second part comprising a connecting section and wherein the connecting sections of the first part and the second part are releasably connected to one another in a first position;

the first part comprising a plurality of supporting arms extending from the connecting section of the first part, and wherein each of the plurality of supporting arms of the first part are operable to contact an inner wall of a beverage container;

the second part comprising a plurality of supporting arms extending from the connecting section of the second part;

the connecting section of the second part comprising a recess and a straw provided in the recess, wherein the straw and the supporting arms of the second part extend in a direction substantially parallel with a longitudinal axis of the device.

2. The straw holding device of claim 1, wherein at least one of the first part and the second part comprises a density lower than the density of water.

3. The straw holding device of claim 1, wherein a straw is provided in the recess of the second part and the straw is secured to the second part.

4. The straw holding device of claim 3, wherein one end of the straw comprises a closed tip and at least one radial opening.

5. The straw holding device of claim 1, wherein the first part and the second part are releasably connected to one another in a first position by a mechanical connection.

6. The straw holding device of claim 1, wherein the first part and the second part are releasably connected to one another in the first position by a cohesive connection.

7. The straw holding device of claim 1, wherein the supporting arms of at least one of the first part and the second part comprise at least one outwardly curved region.

8. The straw holding device of claim 1, wherein the supporting arms of at least one of the first part and the second part comprise deflectable supporting arms.

9. In combination, a beverage container and straw holding device comprising:

a beverage container comprising a base, a cover, and a body;

a straw holding device comprising a first part and a second part;

the first part comprising a plurality of supporting arms that bear against an inner wall of the beverage container;

the second part comprising an annular recess and plurality of supporting arms extending along a longitudinal length of the beverage container;

wherein the supporting arms of the first part are arranged such that the supporting arms of the first part extend beyond the annular recess of the second part;

wherein the first part and the second part are releasably connected to one another in a first state prior to sealing the beverage container;

a straw extending through the annular recess and secured to the straw holding device; and wherein the straw is operable to extend through the cover of the beverage container when the beverage container is opened.

10. The combination of claim 9, wherein at least one of the straw holding device and the straw comprise a density that is less than a density of a liquid to be provided within the beverage container.

11. The combination of claim 9, wherein the straw holding device is connected to an additional part in a first position prior to placement of the cover on the beverage container, and wherein the first part comprises an annular connecting section releasably secured to the straw holding device.

12. The combination of claim 11, wherein the additional part comprises a plurality of supporting arms and wherein contact between the cover and at least one of the plurality of supporting arms of the additional part is operable to displace the additional part relative to the straw holding device.

13. The combination of claim 11, wherein one end of the straw comprises a closed tip and at least one radial opening.

14. A straw holding device operable for use within a beverage container, the straw holding device comprising:

a first part and a second part, each of the first part and the second part comprising a connecting section and wherein the connecting sections of the first part and the second part are releasably connected to one another in a first position;

the first part comprising a plurality of supporting arms extending from the connecting section of the first part, and wherein each of the plurality of supporting arms of the first part are operable to contact an inner wall of a beverage container;

the connecting section of the second part comprising a recess operable to receive a straw that extends substantially parallel to the plurality of supporting arms of the first part.

15. The straw holding device of claim 14, wherein at least one of the first part and the second part comprises a density lower than the density of water.

16. The straw holding device of claim 14, wherein a straw is provided in the recess of the second part and the straw is secured to the second part.

17. The straw holding device of claim 14, wherein the first part and the second part are releasably connected to one another in the first position by a mechanical connection.

18. The straw holding device of claim 14, wherein the first part and the second part are releasably connected to one another in the first position by a cohesive connection.

19. The straw holding device of claim 14, wherein the supporting arms of the first part comprise at least one outwardly curved region.

20. The straw holding device of claim 14, wherein the supporting arms of the first part comprise deflectable supporting arms.

* * * * *